US005865657A

United States Patent [19]

Haven et al.

[11] Patent Number: 5,865,657

[45] Date of Patent: Feb. 2, 1999

[54] FABRICATION OF GATED ELECTRON-EMITTING DEVICE UTILIZING DISTRIBUTED PARTICLES TO FORM GATE OPENINGS TYPICALLY BEVELED AND/OR COMBINED WITH LIFT-OFF OR ELECTROCHEMICAL REMOVAL OF EXCESS EMITTER MATERIAL

[75] Inventors: Duane A. Haven, Cupertino; Paul N. Ludwig, Livermore; Christopher J. Spindt, Menlo Park; Daniel M. Dobkin, Sunnyvale, all of Calif.

[73] Assignee: Candescent Technologies Corporation, San Jose, Calif.

[21] Appl. No.: 660,537

[22] Filed: Jun. 7, 1996

[51] Int. Cl.[6] ..... H01J 9/02

[52] U.S. Cl. ..... 445/24; 445/50

[58] Field of Search ..... 445/24, 50; 313/309

[56] References Cited

U.S. PATENT DOCUMENTS

| | | |
|---|---|---|
| 3,497,929 | 3/1970 | Shoulders . |
| 3,665,241 | 5/1972 | Spindt et al. . |
| 3,755,704 | 8/1973 | Spindt et al. . |
| 3,970,887 | 7/1976 | Smith et al. . |
| 3,998,678 | 12/1976 | Fukase et al. . |
| 4,008,412 | 2/1977 | Yuito et al. . |
| 4,940,916 | 7/1990 | Borel et al. . |
| 5,007,873 | 4/1991 | Goronkin et al. . |
| 5,053,673 | 10/1991 | Tomii et al. . |
| 5,150,019 | 9/1992 | Thomas et al. . |
| 5,150,192 | 9/1992 | Greene et al. . |
| 5,164,632 | 11/1992 | Yoshida et al. . |

(List continued on next page.)

FOREIGN PATENT DOCUMENTS

| | | |
|---|---|---|
| 0 416 625 A2 | 3/1991 | European Pat. Off. . |
| 0 508 737 A1 | 10/1992 | European Pat. Off. . |

OTHER PUBLICATIONS

Betsui, "Fabrication and Characteristics of Si Field Emitter Arrays," *Tech. Dig. IVMC 91*, 1991, pp. 26–29.

Busta, "Vacuum Microelectronics–1992," *J. Micromech. Microeng.*, vol. 2, 1992, pp. 43–74.

Cochran et al., "Low–voltage Field Emission from Tungsten Fiber Arrays in a Stabilized Zirconia Matrix," *J. Mater. Res.*, May/Jun. 1987, pp. 322–328.

Huang et al., "200–nm Gated Field Emitters", *IEEE Electron Device Letters*, Mar. 1993, pp. 121–122.

Spindt et al., "Physical Properties of Thin–film Field Emission Cathodes with Molybdenum Cones," *J. App. Phys.*, Dec. 1976, pp. 5248–5263.

Spindt et al., "Research in Micron–size Field–emission Tubes," *IEEE Conf. Record, 1966 Eighth Conf. Tube Techniques*, 20–22 Sep. 1966, pp. 143–147.

Sune et al., "Fabrication of Silicon–Column–Field Emitters for Microwave Applications," *Tech. Dig., 6th Int'l. Vac. Microelec. Conf.*, 12–15 Jul. 1993, pp. 15–16.

Williams et al., "Fabrication of 80 Å Metal Wires," *Rev. Sci. Instrum.*, Mar. 1984, pp. 410–412.

*Primary Examiner*—Kenneth J. Ramsey

*Attorney, Agent, or Firm*—Skjerven, Morrill, MacPherson, Franklin & Friel LLP; Ronald J. Meetin

[57] ABSTRACT

A gated electron-emitter is fabricated by a process in which particles (26) are deposited over an insulating layer (24). Gate material is provided over the insulating layer in the space between the particles after which the particles and any overlying material are removed. The remaining gate material forms a gate layer (28A or 48A) through which gate openings (30 or 50) extend at the locations of the removed particles. When the gate material deposition is performed so that part of the gate material extends into the spaces below the particles, the gate openings are beveled. The insulating layer is etched through the gate openings to form dielectric openings (32 or 52). Electron-emissive elements (36A or 56A) are formed in the dielectric openings. This typically involves introducing emitter material through the gate openings into the dielectric openings and using a lift-off layer (34), or an electrochemical technique, to remove excess emitter material.

40 Claims, 7 Drawing Sheets

U.S. PATENT DOCUMENTS 5,170,092 12/1992 Tomii et al. .
5,194,780 3/1993 Meyer .
5,249,340 10/1993 Kane et al. .
5,277,638 1/1994 Lee .
5,278,472 1/1994 Smith et al. ..... 313/309
5,316,511 5/1994 Lee .
5,378,182 1/1995 Liu ..... 445/24
5,458,520 10/1995 DeMercurio et al. .
5,462,467 10/1995 Macaulay et al. .
5,534,743 7/1996 Jones et al. ..... 313/309
5,559,389 9/1996 Spindt et al. .
5,562,516 10/1996 Spindt et al. ..... 445/24
5,564,959 10/1996 Spindt et al. .
5,588,894 12/1996 Jin et al. ..... 445/24
5,676,853 10/1997 Alwan ..... 216/11
5,698,934 12/1997 Jin et al. ..... 313/309

FABRICATION OF GATED ELECTRON-EMITTING DEVICE UTILIZING DISTRIBUTED PARTICLES TO FORM GATE OPENINGS TYPICALLY BEVELED AND/OR COMBINED WITH LIFT-OFF OR ELECTROCHEMICAL REMOVAL OF EXCESS EMITTER MATERIAL

CROSS REFERENCE TO RELATED APPLICATIONS

This contains subject matter partially similar to (a) Haven et al, co-filed U.S. patent application Ser. No. 08/660,535, now U.S. Pat. No. 5,755,944, attorney docket No. M-3786 US; (b) Haven et al, co-filed U.S. patent application Ser. No. 08/660,536, attorney docket No. M-3692 US; and (c) Ludwig et al, co-filed U.S. patent application Ser. No. 08/660, 538, attorney docket No. M-3827 US.

FIELD OF USE

This invention relates to the fabrication and structure of electron-emitting devices, commonly referred to as cathodes, suitable for products such as cathode-ray tube ("CRT") displays of the flat-panel type.

BACKGROUND ART

A field-emission cathode (or field emitter) emits electrons upon being subjected to an electric field of sufficient strength. The electric field is produced by applying a suitable voltage between the cathode and an electrode, typically referred to as the anode or gate electrode, situated a short distance away from the cathode.

When a field-emission cathode is utilized in a flat-panel CRT display, electron emission from the cathode occurs across a sizable area. The electron-emitting area is commonly divided into a two-dimensional array of electron-emitting portions, each situated across from a corresponding light-emitting portion to form part or all of a picture element (or pixel). The electrons emitted by each electron-emitting portion strike the corresponding light-emitting portion and cause it to emit visible light.

It is generally desirable that the illumination be uniform (constant) across the area of each light-emitting portion. One method for achieving uniform illumination is to arrange for electrons to be emitted uniformly across the area of the corresponding electron-emitting portion. This typically involves fabricating the electron-emitting portion as a group of small, closely spaced electron-emissive elements.

Various techniques have been investigated for manufacturing electron-emitting devices that contain small, closely spaced electron-emissive elements. Spindt et al, "Research in Micron-Sized Field-Emission Tubes," *IEEE Conf. Rec.* 1966 *Eighth Conf. Tube Techniques*, 20 Sep., 1966, pp. 143–147, describes how small randomly distributed spherical particles are employed to define the locations for conical electron-emissive elements in a flat field-emission cathode. The size of the spherical particles strongly controls the base diameter of the conical electron-emissive elements.

In fabricating an electron-emitting diode having a thick anode, Spindt et al first creates a structure in which an upper molybdenum layer overlies an intermediate dielectric layer situated on a lower molybdenum layer. Spherical polystyrene particles are scattered across the upper molybdenum layer after which "resist", typically alumina, is deposited on top of the structure. Openings are created through the resist by removing the spheres, thereby lifting off portions of the resist situated on the spheres.

The upper molybdenum is etched through the resist openings to create openings through the upper molybdenum. The intermediate dielectric layer is etched through the openings in the resist and upper molybdenum to form cavities through the dielectric layer down to the lower molybdenum. The resist is removed, typically during the cavity formation.

Finally, molybdenum is evaporatively deposited on top of the structure and into the cavities in the intermediate dielectric layer. The evaporation is performed in such a way that the openings through which the molybdenum accumulates in the dielectric cavities progressively close. Conical molybdenum electron-emissive elements are formed in the dielectric cavities, while a continuous molybdenum layer that combines with the upper molybdenum layer to form the anode for the diode simultaneously accumulates on the upper molybdenum.

The utilization of spherical particles to establish the locations, and base dimensions, of electron-emissive elements in Spindt et al is a creative approach to creating an electron-emitting device. However, the electrons emitted by the electron-emissive cones are collected by the directly overlying anode and thus are not utilized to directly activate light-emitting areas. It would be desirable to utilize spherical particles to define the locations for small, closely spaced electron-emissive elements that emit electrons which can be employed to directly activate light-emissive elements in a flat-panel device in a highly uniform manner.

GENERAL DISCLOSURE OF THE INVENTION

The present invention furnishes a group of fabrication processes in which particles, typically spherical, are so utilized in manufacturing gated electron-emitting devices. The particles define the locations, and to a large degree, the lateral areas of electron-emissive elements in the gated electron emitters. Importantly, the fabrication processes of the invention are arranged so that electrons emitted by the electron-emissive elements are available for directly activating elements such as light-emissive regions in a flat-panel device.

The surface density of the particles can readily be set at a high value. Since the locations of the electron-emissive elements are defined by the particles, the surface density of the electron-emissive elements equals the particle surface density. Consequently, a high surface density of electron-emissive elements can easily be attained. By appropriately adjusting the surface density and average size of the particles, the electron-emissive elements can be spaced suitably close together.

Furthermore, the particles can readily be chosen to have a tight size distribution—i.e., the standard deviation in the average particle diameter is quite small. The electron-emissive elements, especially when they are conically shaped, therefore typically occupy largely equal lateral areas. When an electron emitter is fabricated according to the invention using conventional fabrication equipment with normal process control, the electron-emissive elements can readily be made quite similar to one another.

The particles, and therefore the electron-emissive elements, are normally situated at largely random locations relative to one another. Nonetheless, the number of electron-emissive elements per unit area is relatively uniform across the overall electron-emitting area. The net result is that utilization of particles according to the fabrication processes of the invention enables highly uniform electron emission to be achieved, thereby enabling light-emitting regions to be directly activated in a highly uniform manner.

In fabricating a gated electron emitter according to one aspect of the invention, a multiplicity of particles are distributed over an electrically insulating layer. The particles, preferably spherical in shape, are then utilized to form gate openings for the electron emitter. This entails providing electrically non-insulating gate material over the insulating layer at least in space between the particles. As discussed below, "electrically non-insulating" means electrically conductive or electrically resistive. The particles are subsequently removed. During the particle-removal operation, any gate material overlying the particles is simultaneously removed. The remaining gate material forms a gate layer through which the gate openings extend at the locations of the removed particles.

Using the gate layer as a mask, the insulating layer is etched through the gate openings to form corresponding dielectric openings through the insulating layer substantially down to a lower electrically non-insulating region provided below the insulating layer. Electrically non-insulating emitter material is introduced into the dielectric openings to form corresponding electron-emissive elements that are externally exposed through the gate openings. This operation is normally performed by depositing the emitter material over the gate layer and through the gate openings and then removing at least part of the emitter material accumulated over the gate layer outside the dielectric openings. The electron-emissive elements are typically conical in shape.

Removal of excess emitter material overlying the gate layer can be performed in various ways. For example, before depositing the emitter material, a lift-off layer can be formed over the gate layer such that lift-off openings vertically aligned to the gate openings extend through the lift-off layer. In depositing the emitter material, part of the emitter material normally accumulates on the lift-off layer above the gate layer as portions of the emitter material pass through the lift-off and gate openings into the dielectric openings. The lift-off layer is subsequently removed, thereby substantially removing any excess emitter material accumulated over the gate layer. Alternatively, part or all of the emitter material overlying the gate layer can be electrochemically removed without the need for a lift-off layer. In each case, the electron-emissive elements are externally exposed through the gate openings in the resultant structure.

Before distributing the particles over the insulating layer and thus also before providing the gate material over the structure, an intermediate layer can be provided over the insulating layer. The particles are then distributed over the intermediate layer above the insulating layer. The intermediate layer typically functions as an adhesion layer for the later-formed gate layer.

Importantly, the intermediate layer can also inhibit clumping of the particles during the particle distribution step, especially when the particles are distributed over the intermediate layer under the influence of an electric field—i.e., electrophoretically or dielectrophoretically. By inhibiting particle clumping, the particle surface density can be increased. Use of the intermediate layer therefore can significantly improve the characteristics of an electron emitter fabricated according to the invention.

In another aspect of the invention, the gate openings are beveled—i.e., the diameter of each gate opening generally decreases in going downward through the gate openings toward the lower non-insulating region. The diameter of each gate opening reaches a minimum value at or near the bottom of the gate layer. When a lift-off layer is used in removing excess emitter material that accumulates over the gate layer during the deposition of emitter material into the dielectric openings to form electron-emissive elements, the beveling of the gate openings permits the lift-off layer to be made thicker without significantly closing the openings through which the emitter material enters the dielectric openings.

To manufacture the beveled-gate electron emitter, a multiplicity of particles, again preferably spherical, are distributed over an electrically insulating layer. Electrically non-insulating gate material is provided over the insulating layer in such a way that the gate material covers space between the particles and extends into the spaces below the particles above the insulating layer. A non-collimated technique, such as non-collimated sputtering, is preferably utilized to deposit the gate material.

The particles are subsequently removed. Any gate material overlying the particles is removed during the particle removal, thereby leaving gate openings extending through the resulting gate layer at the locations of the removed particles. Since the gate material originally extended into the spaces below the particles, the gate openings are now beveled. With the gate layer serving as an etch mask, the insulating layer is etched through the beveled gate openings to form corresponding dielectric openings through the insulating layer down to a lower electrically non-insulating region.

Electron-emissive elements are formed over the lower non-insulating region in the dielectric openings. This typically involves depositing a lift-off layer over the gate layer, depositing emitter material over the lift-off layer and through the gate openings into the dielectric openings, and removing the lift-off layer to remove any excess emitter material overlying the lift-off layer. As in the first-mentioned aspect of the invention, the electron-emissive elements are now externally exposed through the gate openings.

Alternatively, the emitter material can be deposited over the gate layer and through the gate openings into the dielectric openings without using a lift-off layer. At least part of the excess emitter material overlying the gate layer is removed, typically by an electrochemical technique, such that the electron-emissive elements again are externally exposed. This alternative is attractive because the number of fabrication steps is low and depositing the gate layer by a non-collimated technique, such as non-collimated sputtering, is generally less costly than using a collimated technique.

In fabricating a gated electron emitter according to a further aspect of the invention, the particles are distributed over a pattern-transfer layer formed above the insulating layer. Pedestals corresponding to the particles are created from the pattern-transfer layer by removing the portion of the pattern-transfer layer not shadowed (i.e., not vertically covered) by the particles. The gate material is then provided over the insulating layer at least in space between the pedestals and thus in space not shadowed by the particles. By providing a suitable electrically non-insulating intermediate layer between the insulating layer and the pattern-transfer layer, the gate material can be electrochemically deposited.

The pedestals and any overlying material, including the particles, are removed. The remaining gate material forms a gate layer through which gate openings extend at the locations of the so-removed pedestals. The structure is then processed in the manner described above to form dielectric openings in the insulating layer and then electron-emissive elements in the dielectric openings.

Regardless of which of the present fabrication processes is used, the movement of electrons emitted by the electron-emissive elements in an electron emitter fabricated according to the invention is not impeded by conductive material deposited over the insulating layer. The electrons can move beyond the electron emitter to activate elements, such as light-emitting regions, situated at a suitable distance above the electron emitter. The net result is that the invention furnishes economical processes for manufacturing high-performance electron emitters that can be readily incorporated into flat-panel CRT devices, especially large-area flat-panel CRT displays.

An important feature of the invention is that the candidates for the gate material include metals, such as gold, through which it is difficult to accurately etch small, typically sub-micrometer openings. In particular, when the gate material is provided over the particles, gate openings are formed at the particle or pedestal locations during the act of providing the gate material. There is no need to perform an etch to form the gate openings. Consequently, the gate material can be a difficult-to-etch metal.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

Figure 1A:
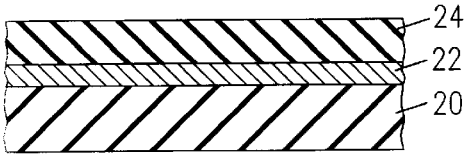
FIGS. 1*a*–1*h* are cross-sectional structural views representing a set of steps for manufacturing a gated field emitter in accordance with the invention.

The present invention utilizes particles distributed across a surface of a structure to define openings in a gate electrode for a gated field-emission cathode. Each field emitter fabricated according to the invention is suitable for exciting phosphor regions on a faceplate in a cathode-ray tube of a flat-panel device such as a flat-panel television or a flat-panel video monitor for a personal computer, a lap-top computer, or a workstation.

The invention furnishes different ways to utilize the particles, typically spherical in shape, to define the gate openings. The field emitter has multiple electron-emissive elements, each of which emits electrons through a corresponding one of the gate openings. Inasmuch as the particles define the locations of the gate openings, the particles also define the locations of the electron-emissive elements.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

Referring to the drawings, FIGS. 1*a*–1*h* (collectively "FIG. 1") illustrate a process for manufacturing a gated field-emission cathode utilizing spherical particles to define gate openings for conical electron-emissive elements according to the teachings of the invention. In the fabrication process of FIG. 1, the starting point is an electrically insulating substrate 20 typically formed with ceramic or glass. See FIG. 1*a*. Substrate 20, which provides support for the field emitter, is configured as a plate. In a flat-panel CRT display, substrate 20 constitutes at least part of the backplate.

A lower electrically non-insulating emitter region 22 lies along the top of substrate 20. Lower non-insulating region 22 may be configured in various ways. At least part of non-insulating region 22 is typically patterned into a group of generally parallel emitter-electrode lines referred to as row electrodes. When non-insulating region 22 is configured in this way, the final field-emission cathode is particularly suitable for exciting light-emitting phosphor elements in a flat-panel CRT display. Nonetheless, non-insulating region 22 can be arranged in other patterns, or can even be unpatterned.

A largely homogenous electrically insulating layer 24 is provided on top of the structure. Insulating layer 24 typically consists of silicon oxide. Alternatively, layer 24 could be formed with silicon nitride. Although not shown in FIG. 1*a*, parts of insulating layer 24 may contact substrate 20 depending on the configuration of lower non-insulating region 22. Part of insulating layer 24 later becomes the emitter/gate interelectrode dielectric.

The thickness of insulating layer 24 should be sufficiently great that the later-created electron-emissive elements are shaped as cones whose tips extend slightly above the top of layer 24. The height of each electron-emissive cone depends on its base diameter which, as described below, is determined by the diameter of a spherical particle used in defining a gate opening for that electron-emissive cone. The thickness of insulating layer 24 is normally 1–2 times the diameter of the spherical particles. A typical range for the insulating layer thickness is 0.1–3 $\mu$m.

Figure 1B:
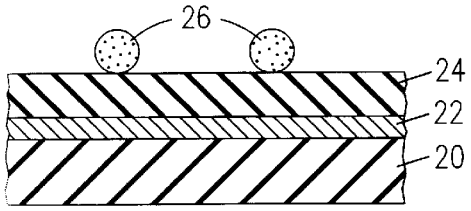
Figure 1C:
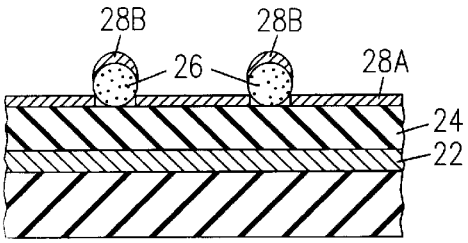

Solid spherical particles 26 are distributed in a random, or largely random, manner across the top of insulating layer 24 as shown in FIG. 1*b*. Spherical particles 26 typically consist of polystyrene. Alternative materials for particles 26 include glass (e.g., silicon oxide), polymers (e.g., latex) other than polystyrene, and polymers coated with functional groups such as alcohol, acid, amide, and sulfonate groups.

When particles 26 consist of polystyrene, they have an average diameter in the range of 0.1–3 $\mu$m, typically 0.3 $\mu$m. The standard deviation in the average particle diameter is normally very small, less than 10%, typically 2%. The average surface density of particles 46 across insulating layer 24 is in the range of $10^6$–$10^{10}$ particles/cm$^2$, preferably $10^7$–$10^9$ particles/cm$^2$. A typical value is $10^8$ particles/cm$^2$.

Spherical particles 26 adhere quite strongly to insulating layer 24. Van der Waals forces are believed to at least partially provide the adherence mechanism. Part or all of spheres 26 may be charged—e.g., negatively when spheres 26 consist of polystyrene. A charge of opposite polarity on initial structure 20/22/24 may assist the adherence mechanism. In any case, once attached to layer 24, particles 26 do not move readily.

Various techniques may be used to distribute spherical particles 26 across insulating layer 24. In one technique, de-ionized water containing suitably small polystyrene spheres is first combined with a reagent-grade alcohol in a beaker. The alcohol is typically isopropanol. Ethanol is an alternative candidate for the alcohol.

In the isopropanol case, the liquid in the resultant isopropanol/water solution is primarily isopropanol, typically over 99% isopropanol by volume. The polystyrene spheres are suspended in the isopropanol/water solution. Nitrogen is bubbled through the solution to make the distribution of spheres more uniform throughout the solution. Alternatively, the solution can be subjected to ultrasonic agitation to improve the uniformity of the spheres throughout the solution.

With initial structure 20/22/24 being manufactured in the form of a generally circular wafer, the wafer is placed in a spin chamber. While the wafer is in the chamber, a controlled amount of the isopropanol/water solution, including the suspended polystyrene spheres, is deposited on top of the wafer so as to cover a selected portion of the upper wafer surface but not run off the top of the wafer. The wafer is then spun for a short time to remove most of the solution. The spinning speed is 200–2000 rpm, preferably 750 rpm. The spinning time is 5–120 sec, preferably 20 sec. Performing the spin in an enclosure (i.e., the spin chamber) allows the atmosphere in the enclosure to saturate with isopropanol, thereby providing a more uniform distribution of the spheres.

During the spin, substantially all of the remaining isopropanol/water solution evaporates, leaving polystyrene spheres 26 behind. If any of the isopropanol/water solution remains, the wafer is dried to remove the remaining isopropanol/water. The drying operation can, for example, be done with a nitrogen jet. Regardless of whether the drying operation is, or is not, done, the wafer is subsequently removed from the spin chamber. In this way, the structure of FIG. 1*b* is produced.

Electrically non-insulating gate material is deposited on insulating layer 24 and spherical particles 26. The gate material deposition is typically performed in a direction substantially perpendicular to the upper surface of layer 24 using a technique such as evaporation or collimated sputtering. The gate material accumulates on layer 24 in space between particles 26 to form an electrically non-insulating gate layer 28A of relatively uniform thickness. See FIG. 1*c*. Portions 28B of the gate material accumulate simultaneously on the upper halves (hemispheres) of particles 26. To avoid having gate material portions 28B bridge to gate layer 28, the thickness of gate layer 28A is normally less than the average radius of spheres 26. The gate material is usually a metal such as chromium, nickel, molybdenum, titanium, tungsten, or gold.

Spherical particles 26 are now removed according to a technique that does not significantly degrade other parts of the structure. During the removal of particles 26, gate material portions 28B are simultaneously removed to produce the structure shown in FIG. 1*d*. Gate openings 30 now extend through gate layer 28A at the locations of removed particles 26. In this way, particles 26 directly define the locations of gate openings 30. Because the formation of gate openings 30 occurs during the deposition of the gate material over particles 26 and is not accomplished by etching the gate material, the candidates for the gate material include gold through which it is difficult to accurately etch small openings—i.e., openings whose diameters are typically less than 1 $\mu$m—that later expose the electron-emissive cones.

Since removed particles 26 are spherical, gate openings 30 are largely circular. When the deposition to form gate layer 28A is performed substantially perpendicular to the upper surface of insulating layer 24, the diameter of each gate opening 50 is approximately equal to the diameter of corresponding removed sphere 26.

A mechanical process is typically used to remove spherical particles 26 when the consist of polystyrene. For example, particles 26 can be removed by an ultrasonic/megasonic operation. A high-pressure water jet could alternatively be used to remove spheres 26.

When an ultrasonic/megasonic operation is employed for the sphere removal, most of spheres 26 are removed during the ultrasonic part of the operation. The ultrasonic operation is typically performed by placing the wafer in a bath of de-ionized water with a small volume percentage (e.g., 1%) of Valtron SP2200 alkaline detergent (2-butylxyethanol and non-ionic surfactant) and subjecting the bath to an ultrasonic frequency for 10 min. After removing the wafer from the ultrasonic bath, the wafer is rinsed with de-ionized water. The megasonic operation, performed after the ultrasonic operation to remove the remainder of spheres 26, typically entails placing the wafer in another bath of de-ionized water with a small volume percentage (e.g., 0.5%) of Valtron SP2200 alkaline detergent and subjecting the bath to a megasonic frequency for 15 min. The wafer is subsequently removed from the megasonic bath, rinsed with de-ionized water, and spun dry.

A detergent which largely neutralizes the charges on particles 26 can be used in place of Valtron SP2200 detergent during both the ultrasonic and megasonic operations. The charge-neutralizing detergent typically includes ionic surfactant.

Using gate layer 28A as an etch mask, insulating layer 24 is etched through gate openings 30 to form corresponding dielectric openings (or dielectric open spaces) 32 through layer 24 down to lower non-insulating region 22. See FIG. 1*e*. Item 24A is the remainder of insulating layer 24. The interelectrode dielectric etch is normally performed in such a manner that dielectric openings 32 undercut gate layer 28A somewhat. The amount of undercutting is chosen to be sufficient to avoid having the later-deposited emitter cone material accumulate on the sidewalls (or side edges) of dielectric open spaces 32 and short the electron-emissive elements to gate layer 28A.

The interelectrode dielectric etch can be performed in various ways such as: (a) an isotropic wet etch using one or more chemical etchants, (b) an undercutting (and thus not fully anisotropic) dry etch, and (c) a non-undercutting (fully anisotropic) dry etch followed by an undercutting etch, wet or dry. When insulating layer 24 consists of silicon oxide, the etch is preferably done in two stages. A fully (i.e., substantially unidirectional) anisotropic plasma etch is performed with carbon tetrafluoride to create vertical openings substantially through insulating layer 24 after which an isotropic wet etch is performed with buffered hydrofluoric acid to widen the initial openings and form dielectric openings 32

A lift-off layer 34 is formed on top of the structure by evaporatively depositing a suitable lift-off material at a moderate angle, typically in the vicinity of 45°, relative to the upper surface of gate layer 28A while rotating the structure, relative to the source of the lift-off material, about an axis perpendicular to the upper surface of insulating layer 24A. See FIG. 1*f*. Part of lift-off layer 34 typically covers the edges of layer 28A at gate openings 30. The lift-off deposition angle is set at a sufficiently low value that substantially none of the lift-off material accumulates on lower non-insulating region 22 in dielectric open spaces 32.

The lift-off material is typically a metal such as aluminum. Alternatively, the lift-off material could be a dielectric such as aluminum oxide, or a salt such as magnesium fluoride, magnesium chloride, or sodium chloride. The lift-off material could even be a metal/dielectric composite. The composition of the lift-off material is not particularly important as long as it can be selectively etched with respect to gate layer 28A, insulating layer 24A, lower non-insulating emitter region 22, and the material that forms the electron-emissive elements.

Figure 1D:
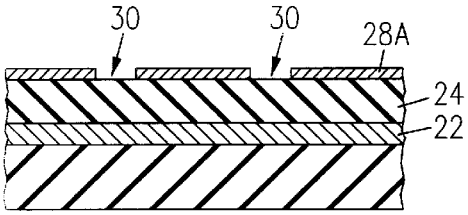
Figure 1E:
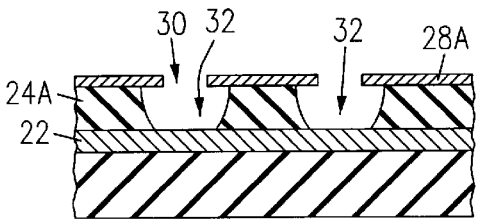

Electrically non-insulating emitter cone material is evaporatively deposited on top of the structure in a direction generally perpendicular to the upper surface of insulating layer 24A. The emitter cone material accumulates on lift-off layer 34 and passes through gate openings 30 to accumulate on lower non-insulating region 22 in dielectric open spaces 32. Due to the accumulation of the cone material on lift-off layer 34, the openings through which the cone material enters open spaces 32 progressively close. The deposition is performed until these openings fully close. As a result, the cone material accumulates in dielectric openings 32 to form corresponding conical electron-emissive elements 36A as shown in FIG. 1*g*. A continuous layer 36B of the cone material is simultaneously formed on lift-off layer 34. The cone material is normally a metal such as molybdenum, nickel, chromium, or niobium, or a refractory metal carbide such as titanium carbide.

Lift-off layer 34 is now removed with a suitable etchant. During the removal of layer 34, excess cone material layer 36B is simultaneously lifted off. FIG. 1*h* shows the resultant electron emitter. Electron-emissive cones 36A are now externally exposed through gate openings 30. Since the cone material deposition was performed generally perpendicular to gate layer 28A, each electron-emissive cone 36A is vertically centered on corresponding gate opening 30 and thus is also vertically centered on the location of corresponding removed spherical particle 26. Consequently, the locations of cones 36A are defined by (the locations of) spheres 26.

Electron-emissive cones 36A are situated at random, or largely random locations relative to one another since the surface distribution of particles 26 was random, or largely random. Nonetheless, the number of cones 36A per unit area does not vary greatly from place to place across the entire electron-emitting area.

The base diameter of each cone 36A is roughly the same as the diameter of corresponding removed sphere 26 dependent on how much the paths of the atoms of the evaporatively deposited cone material differ from forming a parallel beam. Consequently, the average base diameter of cones 36A is controlled by adjusting the average diameter of particles 26. Decreasing the average particle diameter causes the average cone diameter to be decreased by an approximately equal amount, and vice versa. In this way, particles 26 determine the lateral area occupied by the electron-emissive cones. Inasmuch as spheres 26 define the locations of cones 36A, the average spacing between cones 36A is controlled by adjusting the average surface density and average diameter of spheres 26.

The standard deviation in the average diameter of particles 26 is, as noted above, quite small compared to the average particle diameter. The standard deviation in the average base diameter of electron-emissive cones 36A is thus, to a first approximation, equally small compared to the average cone base diameter. Since particles 26 are spherical, the base of each cone 36A is largely circular. The lateral areas occupied by cones 36A are largely equal. By appropriately adjusting parameters such as the sphere diameter and the thickness of interelectrode dielectric layer 24, electron-emissive elements 36A can readily be highly uniform in size and shape.

Electron-emissive cones 36A are preferably fabricated so as to be small and closely spaced together. This is accomplished by utilizing spheres 26 of suitably small average sphere diameter and by distributing an appropriately high density of spheres 26 across the sphere-receiving surface. With there being little variation in the sizes and shapes of cones 36A, the electron emission is relatively uniform across the electron-emitting area. Importantly, this highly desirable feature is achieved largely by controlling the size and surface density of particles 26, thereby enabling the electron current to be well controlled.

Lower non-insulating emitter region 22 typically consists of a lower electrically conductive layer and an upper electrically resistive layer. Of the two layers in region 22, at least the lower conductive layer is patterned into lines running parallel to one another to form emitter row electrodes.

Gate layer 28A may be patterned into a group of gate lines running perpendicular to the emitter row electrodes of lower non-insulating region 22. The gate lines then serve as column electrodes. With suitable patterning being applied to gate layer 28A, the field emitter of FIG. 1*h* may alternatively be provided with separate column electrodes that contact portions of gate layer 28A and run perpendicular to the row electrodes. This gate patterning and, when included, separate column-electrode formation are typically done before etching insulating layer 24 to form dielectric openings 32 but can be done at a later stage in the process.

FIGS. 2*a*–2*j* (collectively "FIG. 2") depict an implementation of the process of FIG. 1 in which the features described in the preceding two paragraphs are introduced into the field emitter. Starting from substrate 20, the first task in the process of FIG. 2, is to create the row electrodes. A blanket layer of electrically conductive emitter-electrode material, preferably a metal such as chromium or nickel, is deposited on top of substrate 20 to a thickness or 0.1–0.4 μm, preferably 0.2 μm. The deposition is typically performed by sputtering.

Figure 2A:
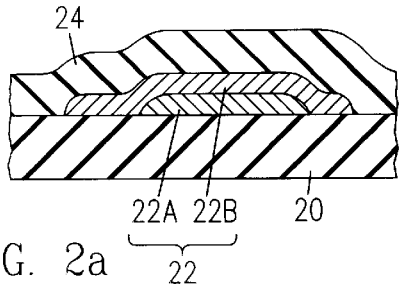
FIGS. 2*a*–2*j* are cross-sectional structural views representing a set of steps in an embodiment of the fabrication process of FIGS. 1*a*–1*h*.
Figure 2B:
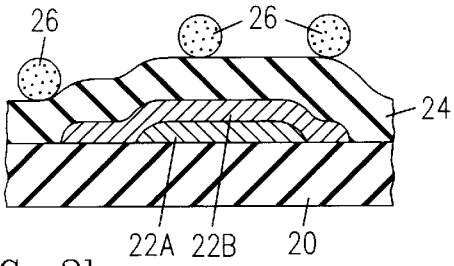
Figure 2C:
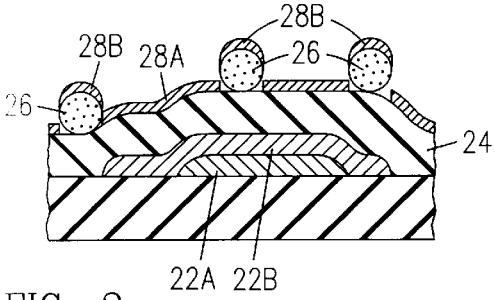
Figure 2D:
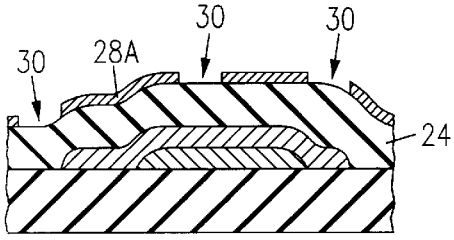
Figure 2E:
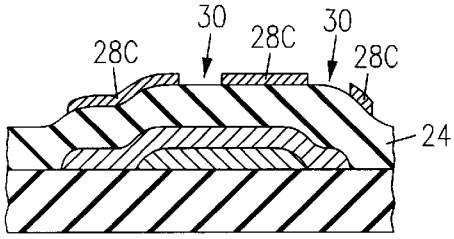

Using a suitable photoresist mask (not shown), the blanket conductive layer is patterned into a group 22A of parallel emitter-electrode lines. FIG. 2*a* depicts one such conductive emitter-electrode line 22A extending horizontally perpendicular to the plane of the figure. The undesired portions of the blanket conductive layer are removed with a wet etchant, such as nitric acid, that undercuts the photoresist. Consequently, the edges of conductive emitter lines 22A are sloped quite strongly. The slope angle—i.e., the angle between the top of substrate 20 and the edge of each line 22A—is typically around 20°. Sloping emitter lines 22A in this way helps to improve the step coverage during subsequent depositions.

A blanket layer of electrically resistive material, preferably cermet or a silicon-carbon-nitrogen compound, is deposited on top of the structure. The thickness of the blanket resistive layer is 0.2–0.7 μm, preferably 0.3 μm. This deposition step is likewise typically performed by sputtering.

Using another suitable photoresist mask (not shown), the blanket resistive layer is patterned into a group 22B of parallel lines that respectively overlie conductive lines 22A. FIG. 2*a* shows one of resistive lines 223. The undesired portions of the blanket resistive layer are removed with a plasma etchant which, like the etchant used to form conductive lines 22A, undercuts the photoresist. The edges of resistive lines 22B are thus likewise strongly sloped, typically on the order of 20°, to improve subsequent deposition step coverage. Each conductive emitter line 22A and overlying resistive line 22B form a row electrode.

Insulating layer 24, consisting of silicon oxide, is formed on top of the structure to a thickness of 0.2–1.0 μm, preferably 0.35 μm. The formation of insulating layer 24 is accomplished by plasma-enhanced chemical vapor deposition ("CVD") at 350° C. Using a further photoresist mask (not shown), portions of insulating layer 24 outside the view of FIG. 2*a* are removed in the periphery of the structure for the purpose of making electrical contacts to the row electrodes.

Spherical particles 26 are distributed across the top of the structure in the manner described above to produce the structure of FIG. 2*b*. Gate material, typically chromium, is deposited on top of the structure as described above to a thickness of 0.02–0.08 μm, preferably 0.04 μm. This leads to the structure of FIG. 2*c*. Spheres 26 are removed in the manner described above to produce the structure of FIG. 2*d*. Gate openings 30 now extend through gate layer 28A.

Using a suitable photoresist mask (not shown), gate layer 28A is patterned into portions whose outer edges underlie the intended locations for column electrodes. See FIG. 2*e* in which items 28C indicate the remaining portions of gate layer 28A. The gate layer patterning is typically performed with a fully anisotropic plasma etchant. Alternatively, a wet chemical etch or a partially anisotropic plasma etch could be used for the gate layer patterning.

The column electrodes are now formed. A blanket layer of electrically non-insulating column-electrode material, preferably a metal, is deposited on top of the structure to a thickness of 0.1–0.5 μm, preferably 0.15 μm when the column-electrode material consists of nickel. Other metals, such as chromium, could be used for the column-electrode material provided that the column-electrode material is selectively etchable with respect to (and therefore differs from) the gate material, or that the column-electrode patterning (described below) is performed in such a way as to avoid significantly damaging gate layer 28C. The column-electrode material deposition is typically performed by sputtering.

Figure 2F:
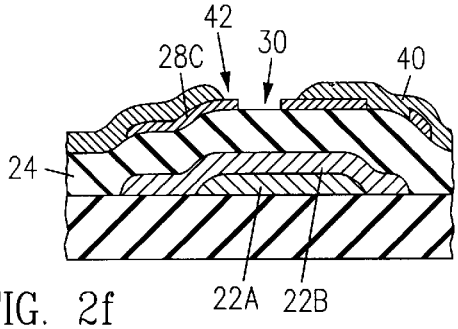
Figure 2G:
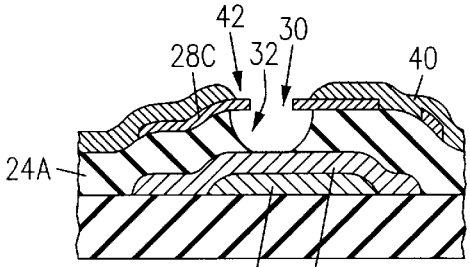

Using a suitable photoresist mask (not shown), the blanket column-electrode layer is patterned into a group 40 of parallel column electrodes that appropriately overlie gate layer portions 28C and extend perpendicular to conductive emitter lines 22A. During the patterning operation, apertures 42 are opened through column electrodes 40 above the locations where electrodes 40 cross emitter lines 22A. FIG. 2*f* shows the resultant structure in which column electrodes 40 extend horizontally parallel to the plane of the figure. The patterning is performed with an etchant, such as nitric acid, that undercuts the photoresist. Accordingly, the edges of column electrodes 40 are strongly sloped, typically on the order of 20°, to improve subsequent deposition step coverage.

The remainder of the electron-emitter fabrication is conducted in largely the manner described for the field emitter of FIGS. 1*e*–1*h*, with gate electrode portions 28C replacing gate layer 28A of FIGS. 1*e*–1*h*. Dielectric openings 32 are created through insulating layer 24 to produce the structure of FIG. 2*g*. Lift-off layer 34 is formed on top of the structure in the manner depicted in FIG. 2*h*.

Figure 2H:
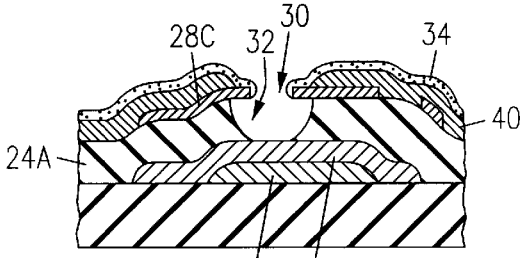
Figure 2I:
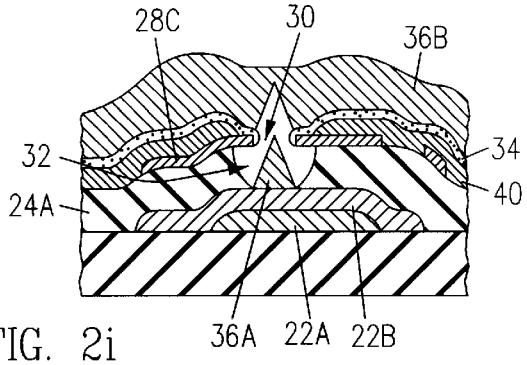
Figure 2J:
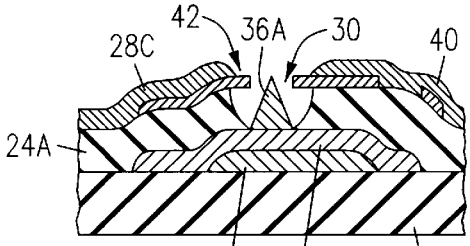

The structure produced by the gate material deposition to create conical electron-emissive elements 36A and continuous excess gate material layer 36B is illustrated in FIG. 2*i*. FIG. 2*j* shows the resultant field emitter after the removal of lift-off layer 34 and the simultaneous removal of excess emitter material layer 36B. In the final field emitter, resistive layer 22B provides a resistance of at least $10^6$ ohms, typically $10^8$ ohms or more, between electron-emissive cones 36A and underlying emitter row lines 22A.

The column electrodes can alternatively be formed at an earlier stage than described above such that the gate layer partially overlies the column electrodes. In particular, the column electrodes can be created over insulating layer 24 before distributing spheres 26 across the top of the structure. In addition to being formed as parallel lines, the column electrodes are provide with apertures above the intended locations for the electron-emissive elements in this alternative. The sphere deposition, gate material deposition, sphere removal, and gate material patterning steps are thereafter performed in the manner described above for the process of FIG. 2.

In the preceding alternative, the column electrodes may consist of the same material—e.g., chromium—as the gate layer, or of material that is attacked by the etchant used to pattern the gate layer. Etching of the column electrodes will thus occur during the gate patterning. However, the column electrodes are normally considerably thicker than the gate layer. By limiting the extent of the gate patterning over etch, the column electrodes will not be significantly damaged during the gate patterning when the column electrodes and gate layer consist of commonly etchable materials.

Figure 1F:
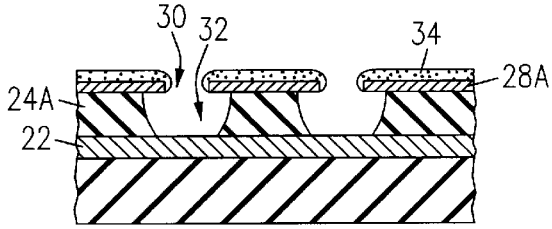
Figure 1G:
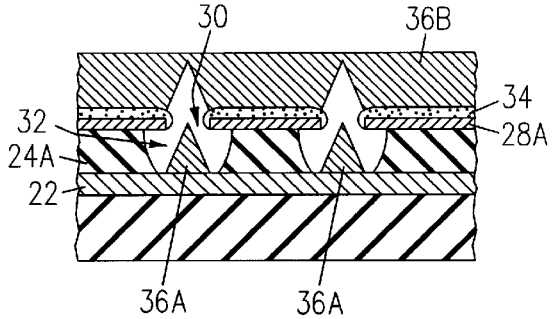
Figure 1H:
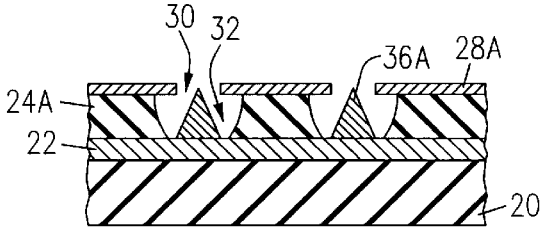

During the deposition of lift-off layer 34, portions of the lift-off material accumulate along the edges of gate layer 28A in FIG. 1*f* and along the edges of gate portions 28C in FIG. 2*h*. This reduces the diameter of the openings through which the emitter cone material can enter dielectric open spaces 32 to form cones 36A. The base diameter, and thus also the height, of cones 36A are slightly reduced.

FIGS. 3*a*–3*h* (collectively "FIG. 3") illustrate a process for manufacturing a gated field-emission device in which spherical particles are used to define the gate openings in a beveled manner that substantially overcomes the foregoing problem. During the deposition of lift-off material that forms a lift-off layer later used to remove excess emitter cone material in the process of FIG. 3, the lift-off material accumulates along the edges of the gate layer in such a manner as to not significantly reduce the diameters of the openings through which the cone material is later deposited to form conical electron-emissive elements.

For gate openings of the same size as those created according to the process of FIG. 1 (or FIG. 2), the electron-emissive cones created according to the process of FIG. 3 are somewhat wider and taller. Also, the process of FIG. 3 enables the lift-off layer to be made thicker, thereby facilitating the lift-off operation.

In the process of FIG. 3, an initial structure consisting of substrate 20, lower non-insulating emitter region 22, and insulating layer 24 is formed in substantially the same way as in the process of FIG. 1. FIG. 3*a*, which repeats FIG. 1*a*, illustrates initial structure 20/22/24 in the process of FIG. 3. Spherical particles 26 are distributed across the top of insulating layer 24 in the manner described above. See FIG. 3*b* which shows one such sphere 26, but is otherwise the same as FIG. 1*b*. Spheres 26 again typically consist of polystyrene.

Figure 3A:
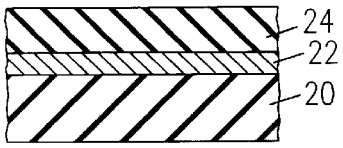
FIGS. 3*a*–3*h* are cross-sectional structural views representing another set of steps for manufacturing a gated field emitter in accordance with the invention.
Figure 3B:
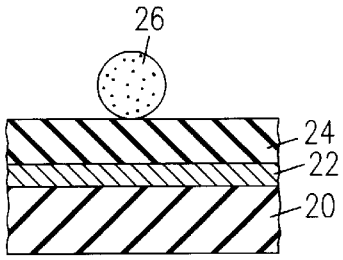
Figure 3C:
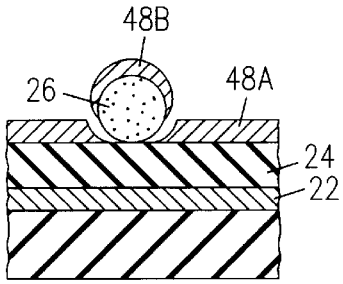
Figure 3D:
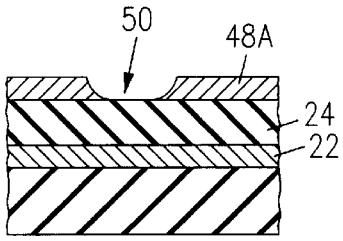
Figure 3E:
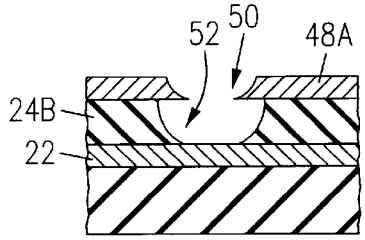

Electrically non-insulating gate material, typically a metal such as chromium or nickel, is deposited on top of the structure in such a way that, in addition to accumulating on insulating layer 24 in the space between spheres 26, the gate material accumulates on portions of layer 24 under the lower halves of spheres 26. FIG. 3*c* illustrates how the gate material so accumulates on insulating layer 24 to form a gate layer 48A that extends into the spaces between layer 24 and the lower halves of particles 26.

The gate material deposition is performed by a uniform non-collimated technique such as non-collimated sputtering (i.e., sputtering in which there is a substantial spread in the natural incident angle of the impinging atoms of the material being sputtered) or plasma-enhanced CVD. During non-collimated sputtering, the pressure is normally 10–100 millitorr.

Alternatively, the non-collimated gate material deposition can be performed by an angled rotational technique such as angled rotational sputtering or angled rotational evaporation. In angled rotational deposition, the gate material is deposited on insulating layer 24 at an angle considerably less than 90° relative to the upper surface of layer 24 while rotating structure 20/22/24, relative to the source of the gate material, about an axis perpendicular to the upper surface of layer 24. Although atoms of the impinging gate material may instantaneously form a collimated beam during angled rotational deposition, the angled rotation of structure 20/22/24 relative to the gate material source causes the overall deposition to be non-collimated.

When the gate material deposition is performed in a uniform non-collimated manner into the spaces below particles 26, the radial distance that gate layer 48A extends (or encroaches) into the area vertically shadowed by spheres 26 can readily equal one third of the average sphere diameter. For example, along any vertical plane through the center of each spherical particle 26, an encroachment of 0.1 $\mu$m from each of the opposite edges of the shadowed area can be achieved at a sphere diameter of 0.3 $\mu$m.

During the gate material deposition, portions 48B of the gate material simultaneously accumulate generally on the upper halves of spheres 26. Because the gate material deposition is non-collimated, gate-material portions 48B typically extend slightly onto the lower halves of spheres 26. To avoid having gate-material portions 48B bridge to gate layer 48A, the gate material thickness is usually less than the average sphere radius, typically 60% of the average sphere radius.

Spherical particles 26 are removed, typically in the manner described above, thereby also removing gate material portions 48B. See FIG. 3*d*. Due to the manner in which the gate material is deposited, beveled gate openings 50 extend through gate layer 48A at the locations of removed spheres 26.

The diameter of each beveled gate opening 50 generally decreases progressively in going from the top of gate layer 48A down to the upper surface of insulating layer 24. Accordingly, the diameter of each gate opening 50 reaches a minimum value at, or close to, the top of layer 24. In addition, the beveled edges of gate layer 48A have concave profiles (concave vertical cross sections) along openings 50. The rate at which the diameter of each gate opening 50 decreases with vertical distance thereby increases progressively in going downward through that opening 50.

Using gate layer 48A as an etch mask, insulating layer 24 is etched through gate openings 50 to create corresponding dielectric openings (or dielectric open spaces) 52 through insulating layer 24 down to lower non-insulating region 22. See FIG. 3*e* in which item 24B is the remainder of insulating layer 24. As in the process of FIG. 1, the interelectrode dielectric etch is performed in a manner that enables dielectric openings 52 to undercut gate layer 48A.

A lift-off layer 54 is formed on top of the structure by evaporatively depositing a lift-off material at a selected angle relative to the upper surface of gate layer 48A while rotating the structure, relative to the source of the lift-off material, about an axis substantially perpendicular to the upper surface of insulating layer 24B. See FIG. 3*f*. The (rotating) lift-off deposition angle is 20°–50°, typically 45°. The lift-off material typically consists of aluminum or aluminum oxide.

Some of the lift-off material accumulates on the beveled edges of gate layer 48A along gate openings 50. The lift-off deposition angle is sufficiently small that substantially none of the lift-off material accumulates on lower-insulating emitter region 22 in dielectric open spaces 52 at the intended locations for the electron-emissive elements. While some of the lift-off material may also accumulate along the sidewalls of dielectric openings 52 depending on the value of the deposition angle, this material will normally be removed during the (later) removal of lift-off layer 54.

Figure 3F:
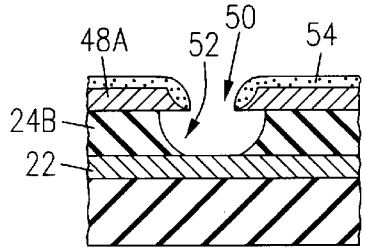
Figure 4:
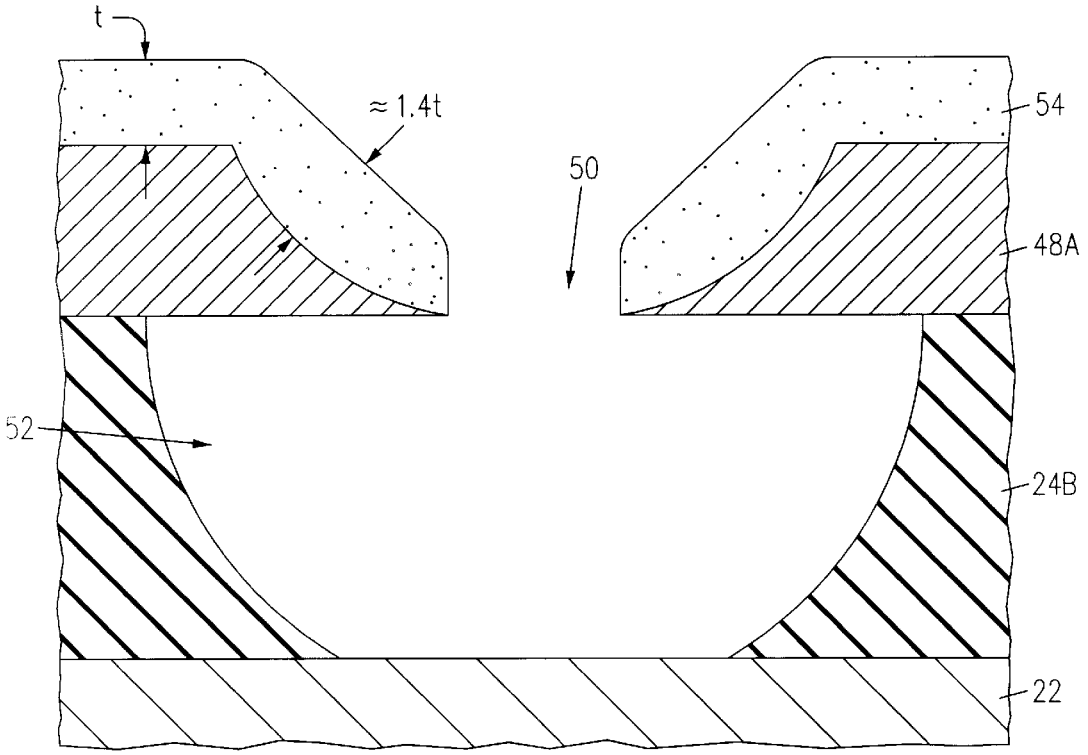
FIG. 4 is an expanded cross-sectional structural view of a portion of FIG. 3*f* centering around the illustrated gate opening.

FIG. 4 illustrates an enlarged view of a portion of FIG. 3*f* centered around gate opening 50 for a simulation in which the lift-off deposition angle is approximately 45°. As FIG. 4 indicates, the lift-off material reaches a greater thickness along the beveled edges of gate layer 48A than along its upper surface. Letting t be the thickness of lift-off layer 54 along the top of gate layer 48A, the thickness of lift-off layer 54 reaches a maximum value approximately equal to 1.4 t along the beveled edges of gate opening 50.

Importantly, the lift-off material accumulates on the beveled edges of gate layer 48A in such a way as to not extend significantly beyond the edges of layer 48A. That is, the diameter of each opening through lift-off layer 54 is approximately the same as the minimum diameter of corresponding gate opening 50. Although the simulation of FIG. 4 applies particularly to a 45° lift-off material deposition angle, it appears that the diameters of the openings through which the emitter material is deposited to form the emitter cones will not be significantly reduced when the lift-off deposition angle is elsewhere in the range of 20°–50°.

Figure 3G:
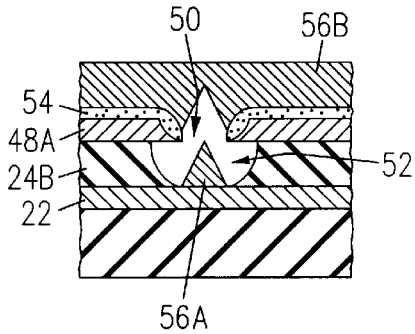

Electrically non-insulating emitter cone material, again typically a metal such as molybdenum, nickel, chromium, or niobium, or a refractory metal carbide such as titanium carbide, is evaporatively deposited on top of the structure in the manner described above. The openings through which the emitter cone material enters dielectric open spaces 52 close as the deposition proceeds. Conical electron-emissive elements 56A are thereby respectively formed in open spaces 52 as shown in FIG. 3*g*. Since the openings through which the cone material can enter open spaces 52 in the process of FIG. 3 are larger than the corresponding openings in the process of FIG. 1, electron-emissive cones 56A grow wider and taller than cones 36A for the same minimum gate-opening diameter. A continuous layer 56B of the cone material accumulates on lift-off layer 54 during the emitter material deposition.

Figure 3H:
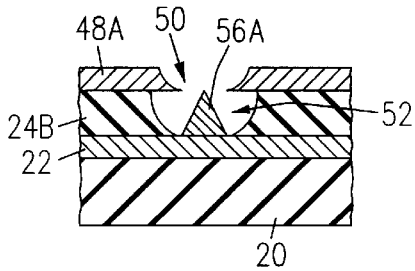

Lift-off layer 54 is removed with a suitable etchant, thereby lifting off excess cone material layer 56B. The resulting field emitter is depicted in FIG. 3*h*. Cones 56A are externally exposed through gate openings 30. Inasmuch as the emitter material deposition is performed largely perpendicular to the upper surface of gate layer 48A, each electron-emissive cone 56A is vertically centered on corresponding gate opening 50. Each gate opening 50 is, in turn, centered on the location of corresponding removed sphere 26. Akin to the process of FIG. 1, spheres 26 thus define the locations of cones 56A.

Likewise, gate openings 50 are generally circular along the bottom of gate layer 48A. Accordingly, the bases of cones 56A are largely circular. Since spheres 26 are largely spherical and vary little in diameter, cones 56A are all of approximately the same size. With suitable control being exerted over the fabrication process parameters, the electron emission from cones 56A is relatively uniform across the electron-emitting area. The average spacing between cones 56A is controlled by adjusting the surface density and average diameter of spheres 26 to control the magnitude of the electron emission.

As in a field emitter manufactured according to the process of FIG. 1, lower non-insulating emitter region 22 in a field emitter manufactured according to the process of FIG. 3 typically consists of a lower electrically conductive layer and an upper electrically resistive layer. Likewise, at least the lower conductive layer is patterned into lines running parallel to one another to form emitter row electrodes.

A field emitter fabricated according to the process of FIG. 3 is also typically provided with column electrodes that contact portions of gate layer 48A and extend perpendicular to the row electrodes. To achieve these features, the process of FIG. 3 can be implemented in largely the same way that the process of FIG. 2 implements the process of FIG. 1. The abovedescribed process variation in which the column electrodes are formed before the gate layer can also be utilized in implementing the process of FIG. 3.

Figure 5A:
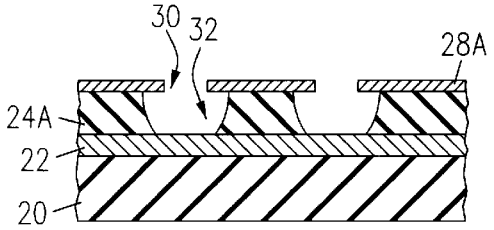
FIGS. 5*a*–5*c* are cross-sectional structural views representing a sequence of steps for completing the fabrication of a gated field emitter in accordance with the invention starting from the intermediate structure of FIG. 1*e*.
Figure 5B:
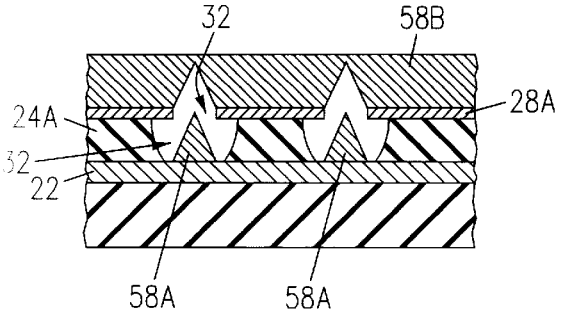
Figure 5C:
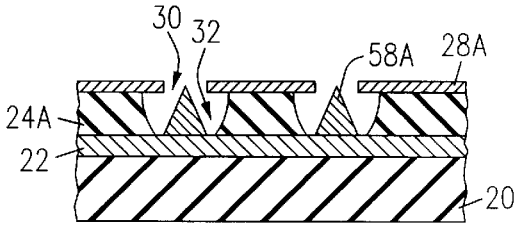

FIGS. 5*a*–5*c* (collectively "FIG. 5") illustrate a variation of the process of FIG. 1 in which excess emitter material that accumulates over gate layer 28A is removed electrochemically rather than with a lift-off layer. The variation of FIG. 5 begins with FIG. 1*e* repeated here as FIG. 5*a*.

Electrically non-insulating emitter cone material is evaporatively deposited on top of the structure of FIG. 5*a* in a direction generally perpendicular to the upper surface of insulating layer 24A. The emitter cone material accumulates on gate layer 28A and passes through gate openings 30 to form corresponding electron-emissive elements 58A on lower non-insulating emitter region 22 in dielectric openings 32. The openings through which the emitter material enters dielectric openings 32 progressively close. With the deposition being conducted until these openings fully close, electron-emissive elements 58A generally form as cones. See FIG. 5*b*. A continuous layer 58B of the emitter cone material is simultaneously formed on gate layer 28A.

Candidates for the cone material here include molybdenum, nickel, chromium, niobium, and titanium carbide—i.e., all the materials described above for the emitter cone material in the process of FIG. 1. However, since excess emitter cone material is to be removed electrochemically in the process sequence of FIG. 5, the cone material here differs from the gate material.

Excess emitter layer 58B is electrochemically removed, preferably according to the technique disclosed in Spindt et al, U.S. patent application Ser. No. 8/610,729, filed 5 Mar., 1996, the contents of which are incorporated by reference herein. FIG. 5*c* depicts the resultant field-emission structure which is substantially identical to the field emitter of FIG. 1*g*. Electron-emissive cones 58A are now externally exposed through gate openings 30. As with cones 36A in the process of FIG. 1, the locations of cones 58A are defined by spheres 26.

Similarly, excess emitter material that accumulates above gate layer 48A in the process of FIG. 3 can be removed electrochemically instead of being lifted off. The variation is performed on the structure of FIG. 3*e* in the same manner as the preceding variation is performed on the structure of FIG. 1*e*. That is, electrically non-insulating emitter material is deposited on gate layer 48A and through beveled gate openings 30 into dielectric openings 52 to form conical electron-emissive elements after which the excess emitter material overlying gate layer 48A outside dielectric openings 52 is electrochemically removed.

The gate layer may be formed with two or more sublayers in an electron emitter fabricated according to the invention. One or more intermediate layers that perform various functions may be situated between the interelectrode dielectric layer and the gate layer. For example, such an intermediate layer can perform an adhesion function—i.e., the intermediate layer adheres well to both insulating layer 24 and the gate layer when the gate layer itself does not adhere well to the interelectrode dielectric material. The intermediate layer could alternatively or additionally act to improve the distribution of spherical particles 26 across the surface that receives particles 26. When the intermediate layer consists of electrically non-insulating material, the intermediate layer normally forms part of the gate electrode.

FIGS. 6*a*–6*i* (collectively "FIG. 6") depict a variation of the process of FIG. 1 in which the features described in the foregoing paragraph are utilized in manufacturing a gated field-emission cathode according to the invention's teachings. As described below, the deposition of particles 26 in the process of FIG. 6 is performed under the influence of an applied electric field according to an electrophoretic or dielectrophoretic technique. The process of FIG. 6 begins with structure 20/22/24 of FIG. 1*a*, repeated here as FIG. 6*a*.

Figure 6A:
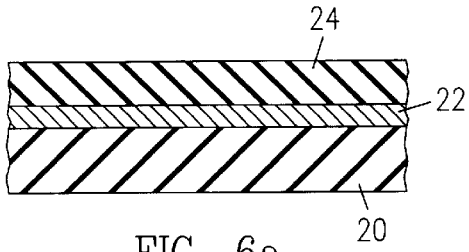
FIGS. 6*a*–6*i* are cross-sectional structural views representing a further set of steps for manufacturing a gated field emitter in accordance with the invention.
Figure 6B:
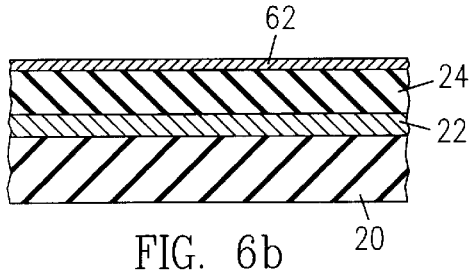
Figure 6C:
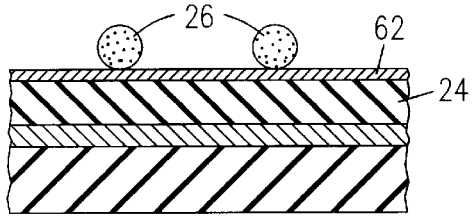

An intermediate layer 62 is deposited on insulating layer 24 to a relatively uniform thickness as shown in FIG. 6*b*. Intermediate layer 62 typically consists of material that adheres well to layer 24 and also adheres well to the gate material subsequently deposited on layer 62.

Insulating layer 24 sometimes has surface defects which, in the absence of intermediate layer 62, could cause particles 26 to clump together as they are electrophoretically or dielectrophoretically deposited across layer 24. Even if layer 24 does not have such surface defects, layer 24 may sometimes consist of material which, again in the absence of intermediate layer 62, could cause particles 26 to clump together during electrophoretic or dielectrophoretic particle deposition across layer 24.

Intermediate layer 62 consists of material that significantly inhibits particles 26 from clumping together as they are electrophoretically or dielectrophoretically deposited on layer 62. Since intermediate layer 62 overlies insulating layer 24, the use of layer 62 substantially overcomes the clumping problem during the electrophoretic or dielectrophoretic particle deposition. By inhibiting particle clumping, the particle surface density can be increased.

Intermediate layer 62 may consist of electrically non-insulating material or electrically insulating material dependent on the desired adhesion and clumping-inhibiting characteristics. Layer 62 typically consists of metal, preferably chromium having a thickness of 5–10 nm, typically 7.5 nm. As evidenced by experiments performed under our direction, clumping of small electrophoretically deposited polystyrene spheres on a freshly deposited chromium surface is considerably less than the clumping of such particles on a silicon oxide surface, especially when the silicon oxide surface has been subjected to additional processing. Using chromium to form intermediate layer 62 thereby significantly reduces clumping during electrophoretic deposition when insulating layer 24 consists of silicon oxide. Chromium also adheres well to silicon oxide. Since layer 62 consists of metal, part of layer 62 later forms part of the gate electrode.

Spherical particles 26 are electrophoretically or dielectrophoretically deposited across the top of intermediate layer 62. See FIG. 6*c*. The electrophoretic or dielectrophoretic deposition is performed in the manner described in Haven et al, U.S. patent application Ser. No. 08/660,535, cited above, the contents of which are incorporated by reference herein. In particular, electrophoretic deposition is utilized to deposit particles 26, thereby enabling the particle surface density to be increased to a value typically on the order of $5\times10^8$ particles/$cm^2$.

As described further in Haven et al, Ser. No. 08/660,535, attorney docket No. M-3786 US, the electrophoretic deposition is performed in a cell that contains fluid in which spheres 26 are suspended. An upper electrode situated in the fluid serves as the cathode during the electrophoretic deposition. Intermediate layer 62 is utilized as the anode. A voltage in the range of 1–100 volts, typically 15 volts, is applied between the anode and the cathode to produce an applied electric field that causes spheres 26 to deposit on layer 62.

After completing the electrophoretic sphere deposition, electrically non-insulating gate material is deposited in two stages on top of the structure in a direction generally perpendicular to the upper surface of insulating layer 24. Both stages of the deposition are typically performed by collimated evaporation. The gate material in the first deposition stage differs from the gate material in the second deposition stage.

Figure 6D:
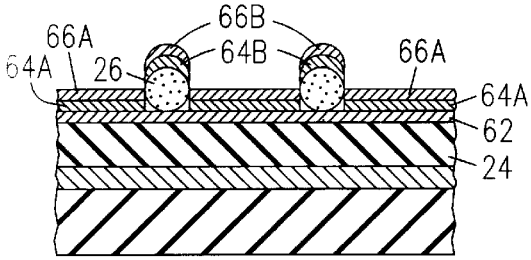

The first stage gate material accumulates on intermediate layer 62 in the space between particles 26 to form a gate sublayer 64A of relatively uniform thickness as shown in FIG. 6*d*. Portions 64B of the first stage material accumulate simultaneously on the top halves of spheres 26. The second stage gate material accumulates on gate sublayer 64A in the space between particles 26 to form another gate sublayer 66A of relatively uniform thickness. Portions 66B of the second stage material accumulate on first stage portions 64B during the formation of gate sublayer 66A.

The first stage gate material can be chromium, molybdenum, titanium, or tungsten. When intermediate layer 62 consists of chromium, the first stage gate material typically consists of chromium deposited to a thickness of 2.5–7.5 nm typically 5 nm. The chromium in gate sublayer 64A improves the adhesion of gate sublayer 66A. The second stage gate material typically consists of gold deposited to a thickness of 20–50 nm, typically 30 nm.

Figure 6E:
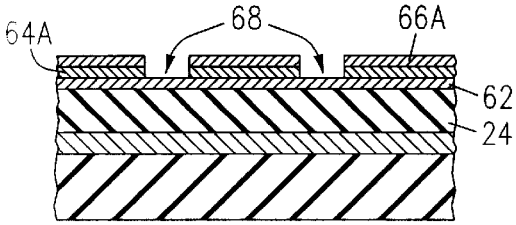

Spheres 26 are removed so as to remove gate material portions 64B and 66B. FIG. 6*e* shows the resultant structure. Gate sublayers 64A and 66A form a composite gate layer 64A/66A through which largely circular gate openings 68 extend down to intermediate layer 62. Since gate openings 68 are created during the deposition of the first and second stage gate materials over spheres 26 without the necessity for etching the second stage gate material, difficult-to-etch gold is suitable for the second stage gate material.

The removal of spheres 26 (including gate material portions 64B and 66B) can be performed according to the technique employed in process of FIG. 1. Alternatively, spheres 26 can be chemically removed by dissolving them in a solvent such as xylene.

Figure 6F:
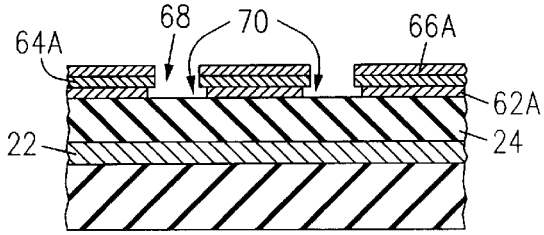

Using composite gate layer 64A/66A as an etch mask, intermediate layer 62 is uniformly etched through gate openings 68 to form largely circular intermediate openings 70 down to insulating layer 24. FIG. 6*f* illustrates the resultant structure in which item 62A is the remainder of intermediate layer 62. Remaining intermediate layer 62A forms a lower part of the gate electrode.

The intermediate-layer etch, typically performed with a chlorine plasma, can be conducted in a fully anisotropic (substantially unidirectional) manner or in a partly isotropic manner. FIG. 6*f* illustrates an example in which the intermediate layer etch is partly isotropic so that intermediate openings 70 slightly undercut gate sublayer 64A. Each intermediate opening 70 is vertically aligned to corresponding gate opening 68 to form a composite gate opening 68/70.

Using composite gate layer 62A/64A/66A as an etch mask, insulating layer 24 is etched through composite gate openings 68/70 to form dielectric open spaces (or dielectric openings) 72 down to lower non-insulating emitter region 22. See FIG. 6*g* in which item 24C is the remainder of insulating layer 24. The interelectrode dielectric etch is normally performed in the manner described above for the process of FIG. 1 so that dielectric open spaces 72 undercut composite gate layer 62A/64A/66A slightly.

Figure 6G:
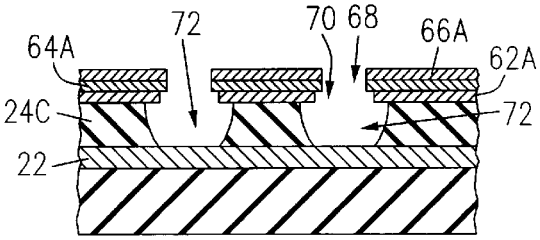
Figure 6H:
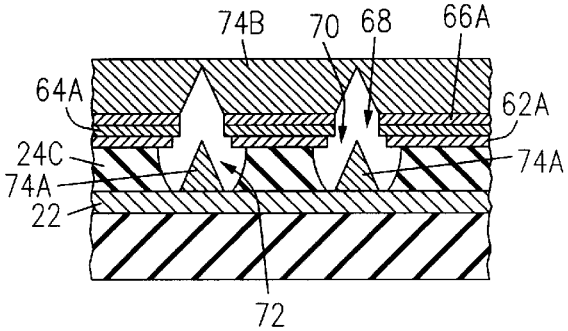

Electrically non-insulating emitter cone material typically consisting of any of the materials described above for the process of FIG. 1, provided that the emitter cone material differs from the gate material, is evaporatively deposited on top of the structure of FIG. 6*g* in a direction generally perpendicular to the upper surface of insulating layer 24C. The cone material accumulates on gate layer 62A/64A/66A and passes through gate openings 68/70 to form corresponding conical electron-emissive elements 74A as shown in FIG. 6*h*. A continuous layer 74B of the emitter cone material simultaneously forms on upper gate sublayer 66A.

Figure 6I:
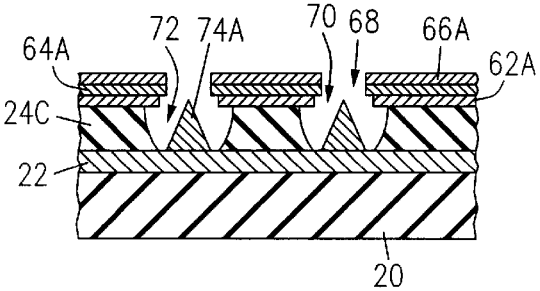

Excess cone material layer 74B is electrochemically removed in the manner generally described in Spindt et al, U.S. patent application Ser. No. 8/610,729, cited above. The resultant field emitter is depicted in FIG. 6*i*. Electron-emissive cones 74A are externally exposed through gate openings 68/70.

Each electron-emissive cone 74A is vertically aligned to its composite gate opening 68/70. Since spheres 26 determine the locations of original gate openings 68, the locations of cones 74A are determined by spheres 26. Also, the base of each cone 74A is largely circular. The comments made above about achieving highly uniform electron emission in an electron emitter manufactured according to the process of FIG. 1 apply equally well to the field emitter of FIG. 6*i*.

In the foregoing processes/process sequences, spherical particles 26 are utilized to directly define gate openings. Particles 26 can, however, be employed to first define solid regions that have the desired lateral shapes for the gate openings. These solid regions, normally circular cylinders, are then used to define the gate openings.

FIGS. 7*a*–7*g* (collectively "FIG. 7") illustrate an example of the front-end portion of such a fabrication process in which the gate openings for a gated field-emission cathode are created from solid regions whose shapes are defined by spherical particles 26 in accordance with the invention. The process sequence of FIG. 7 begins with structure 20/22/24 of FIG. 1*a*, repeated here as FIG. 7*a*.

Figure 7A:
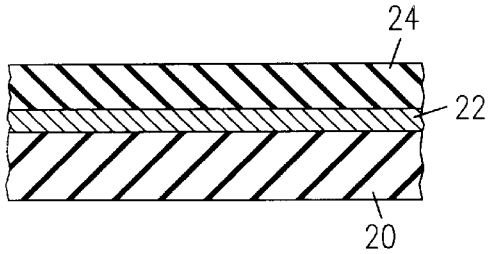
FIGS. 7*a*–7*g* are cross-sectional structural views representing a sequence of steps for beginning the fabrication of a gated field emitter in accordance with the invention. The process sequence of FIGS. 7*a*–7*g* can, for example, be completed according to the process sequence of FIGS. 1*e*–1*h*.
Figure 7B:
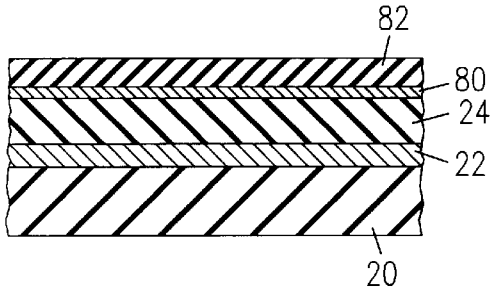

An electrically non-insulating intermediate layer 80, which later serves as a lower part of the gate layer, is deposited on insulating layer 24 as shown in FIG. 7*b*. Intermediate non-insulating layer 80 typically consists of a metal such as chromium or titanium. A pattern-transfer layer 82 is formed on intermediate layer 80. Pattern-transfer layer 82 may consist of various materials such as photoresist or inorganic dielectric material.

Figure 7C:
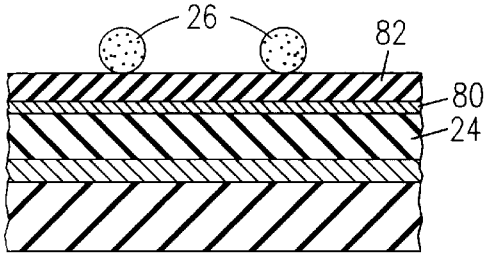
Figure 7D:
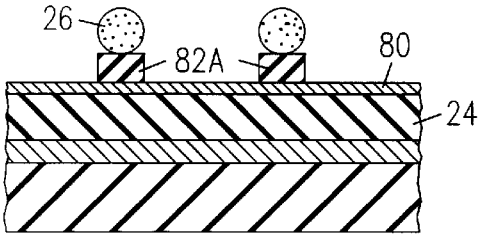

Particles 26 are distributed across the upper surface of pattern-transfer layer 82 using the random, or largely random, technique described above for the process of FIG. 1. FIG. 7*c* illustrates the structure at this point. The portion of pattern-transfer layer 82 not shadowed—i.e., not vertically covered—by particles 26 is removed as shown in FIG. 7*d*. Generally circular pedestals 82A are thereby formed as the remainder of layer 82. Each pedestal 82A underlies a corresponding one of particles 26.

When pattern-transfer layer 82 consists of photoresist, layer 82 is exposed to actinic radiation, typically ultraviolet light, using spherical particles 26 as an exposure mask to prevent the photoresist portions below particles 26 from being subjected to the actinic radiation. The exposed photoresist changes chemical composition. A development operation is then performed on the structure to remove the exposed photoresist, leading to the structure depicted in FIG. 7*d*. When layer 82 exists of inorganic dielectric material, an anisotropic etch is performed on layer 82 in a direction generally perpendicular to the upper surface of insulating layer 24 using particles 26 as an etch mask. The non-shadowed portion of layer 82 is removed during the etch, again leading to the structure of FIG. 7*d*.

Figure 7E:
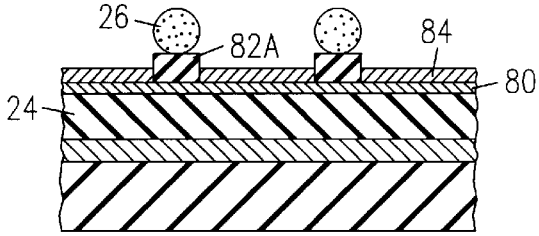

Electrically non-insulating gate material is deposited on top of the structure. The gate material deposition is preferably done by an electrochemical technique using non-insulating intermediate layer 80 as the deposition cathode. A deposition anode is situated in the deposition electrolyte above particles 26. During the electrochemical deposition, gate material accumulates on the exposed part of intermediate layer 80 to form an electrically non-insulating upper gate sublayer 84 as depicted in FIG. 7*e*.

Figure 7F:
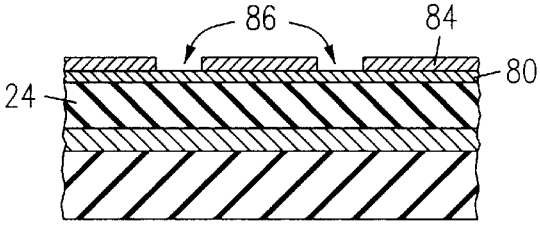

Pedestals 82A and particles 26 are removed to produce the structure of FIG. 7*f*. Upper gate openings 86 extend through upper gate sublayer 84 at the locations of removed pedestals 82A below particles 26. The removal of pedestals 82A and particles 26 can be performed in various ways. For example, pedestals 82A can be removed with a suitable chemical or plasma etchant, thereby simultaneously removing particles 26. Alternatively, particles 26 can be removed after which pedestals 82A are removed.

Using upper gate sublayer 84 as an etch mask, non-insulating intermediate layer 80 is anisotropically etched through upper gate openings 86 to form corresponding intermediate openings 88 through intermediate layer 80 down to insulating layer 24. See FIG. 7*g*. Each intermediate opening 88 is vertically concentric with, and of substantially the same diameter as, overlying upper gate opening 86. The remainder 80A of intermediate layer 80 is now a lower gate sublayer, intermediate openings 88 thereby being lower gate openings. Accordingly, gate sublayers 80A and 84 constitute a composite gate layer in which each pair of corresponding gate openings 86 and 88 forms a composite gate opening.

Figure 7G:
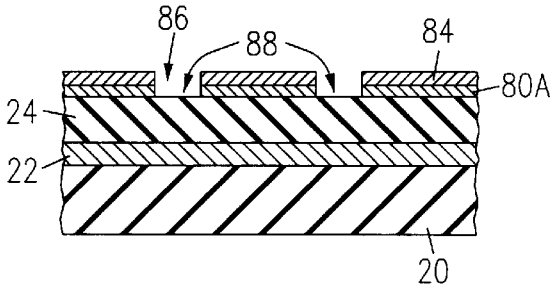

Aside from the fact that the gate layer in the structure of FIG. 7*g* consists of sublayers 80A and 84 and except for associated labeling differences, the structure of FIG. 7*g* is substantially the same as the structure of FIG. 1*d*. Items 80A/84 and 86/88 in FIG. 7*g* respectively correspond to items 28A and 30 in FIG. 1*d*. Subject to these labeling differences, the structure of FIG. 7*g* is now completed according to the back-end process sequence of FIGS. 1*e*–1*h*. In the same way, the front-end process sequence of FIG. 7 can be completed according to the back-end process sequence of FIGS. 2*e*–2*j* or the back-end process sequence of FIG. 5.

Figure 8:
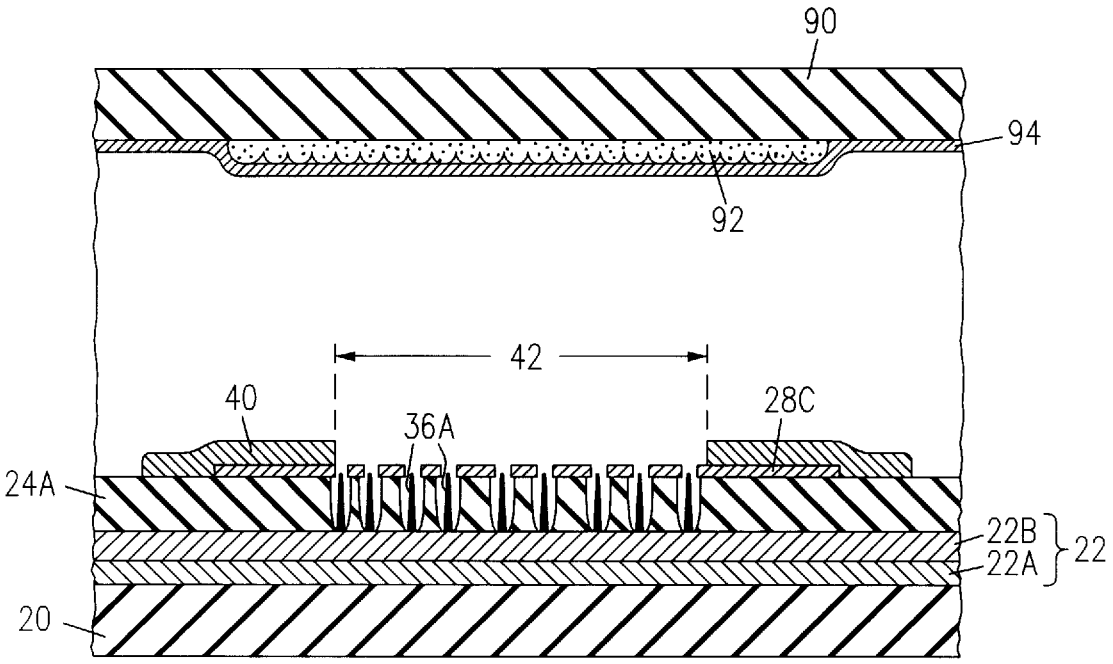
FIG. 8 is a cross-sectional structural view of a flat-panel CRT display that incorporates a gated field emitter, such as that of FIG. 2*j*, fabricated according to the invention.

FIG. 8 depicts a typical example of the core active region of a flat-panel CRT display that employs an area field emitter, such as that of FIG. 2*j*, manufactured according to the invention. Substrate 20 forms the backplate for the CRT display. Lower non-insulating region 22 is situated along the interior surface of backplate 20 and consists of conductive layer 22A and overlying resistive layer 22B. The emitter-electrode lines (row electrodes) of conductive layer 22A here extend horizontally parallel to the plane of FIG. 8.

A group of column electrodes 40, one of which is depicted in FIG. 8, are situated on gate layer 28C. Column electrodes 40 here run perpendicular to the plane of FIG. 8. Each column-electrode aperture 42 exposes a multiplicity of electron-emissive elements 36A in the field emitter of FIG. 8.

A transparent, typically glass, faceplate 90 is located across from baseplate 20. Light-emitting phosphor regions 92, one of which is shown in FIG. 8, are situated on the interior surface of faceplate 90 directly across from corresponding column-electrode aperture 42. A thin electrically conductive light-reflective layer 94, typically aluminum, overlies phosphor regions 92 along the interior surface of faceplate 90. Electrons emitted by the electron-emissive elements pass through light-reflective layer 94 and cause phosphor regions 92 to emit light that produces an image visible on the exterior surface of faceplate 90.

The core active region of the flat-panel CRT display typically includes other components not shown in FIG. 8. For example, a black matrix situated along the interior surface of faceplate 90 typically surrounds each phosphor region 92 to laterally separate it from other phosphor regions 92. Focusing ridges provided over the interelectrode dielectric layer help control the electron trajectories. Spacer walls are utilized to maintain a relatively constant spacing between backplate 20 and faceplate 90.

When incorporated into a flat-panel display of the type illustrated in FIG. 8, a field emitter manufactured according to the invention operates in the following way. Light-reflective layer 94 serves as an anode for the field-emission cathode. The anode is maintained at high positive voltage relative to the gate and emitter lines.

When a suitable voltage is applied between (a) a selected one of the gate lines (column electrodes) and (b) a selected one of the emitter lines (row electrodes), the selected gate line extracts electrons from the electron-emissive elements at the intersection of the two selected lines and controls the magnitude of the resulting electron current. Desired levels of electron emission typically occur when the applied gate-to-emitter parallel-plate electric field reaches 20 volts/$\mu$m or less at a current density of 1 Ma/cm$^2$ as measured at the phosphor-coated faceplate of the flat-panel display when phosphor regions 92 are high-voltage phosphors. Upon being hit by the extracted electrons, the phosphor regions emit light.

Directional terms such as "lower" and "down" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, the distribution of particles 26 across interelectrode dielectric layer 24 in the process of any of FIGS. 1–3 can be performed electrophoretically or dielectrophoretically without using an intervening anti-clumping layer as utilized in the process of FIG. 6. A higher particle surface density could still typically be utilized. The techniques disclosed in Haven et al, U.S. patent application Ser. No. 08/660,535, attorney docket No. cited above, again may be used to electrophoretically or dielectrophoretically deposit particles 26.

After creating a structure in which gate openings extend through a gate layer down to insulating layer 24 above lower non-insulating emitter region 22, the thickness of the gate layer can be increased by selectively depositing further electrically non-insulating gate material on the gate layer. The further gate material deposition can be performed by an electrochemical technique. In general, the further gate material deposition can be performed before or after removing particles 26.

Instead of using a rotational deposition procedure to form lift-off layer 34 or 54, deposition of the lift-off material can be performed from multiple sources, typically at least four, situated at fixed locations around the wafer for evaporatively depositing the lift-off material at suitable, normally equal, moderate angles relative to the upper surface of insulating layer 24. Line-of-sight deposition techniques other than evaporation can be used to form lift-off layer 34 or 54. An electropolishing operation can be conducted to round the edges of the gate layer at the gate openings.

Substrate 20 can be deleted if lower non-insulating region 22 is a continuous layer of sufficient thickness to support the structure. Insulating substrate 20 can be replaced with a composite substrate in which a thin insulating layer overlies a relatively thick non-insulating layer that furnishes structural support.

The electron-emissive elements can have shapes other than cones. The area electron emitters produced according to the manufacturing processes of the invention can be employed to make devices other than flat-panel CRT displays. In particular, the present electron emitters can be used in general vacuum environments that require gated electron sources. Various modifications and applications may thus be made by those skilled in the art without departing from the true scope and spirit of the invention as defined in the appended claims.

We claim:

1. A method comprising the steps of:

distributing a multiplicity of particles over an electrically insulating layer;

providing electrically non-insulating gate material over the insulating layer at least in space between the particles;

removing the particles and substantially any material overlying the particles such that the remaining gate material forms a gate layer through which gate openings extend at the locations of the so-removed particles;

etching the insulating layer through the gate openings to form corresponding dielectric openings through the insulating layer substantially down to a lower electrically non-insulating region provided below the insulating layer; and introducing electrically non-insulating emitter material into the dielectric openings to form corresponding electron-emissive elements over the lower non-insulating region such that the electron-emissive elements are externally exposed through the gate openings.

2. A method as in claim 1 wherein the particles are largely spherical.

3. A method as in claim 1 wherein the electron-emissive elements are operable in field-emission mode.

4. A method as in claim 1 wherein the introducing step comprises:

forming a lift-off layer over the gate layer such that lift-off openings vertically aligned to the gate openings extend through the lift-off layer;

depositing the emitter material over the lift-off layer and through the lift-off and gate openings into the dielectric openings; and removing the lift-off layer so as to substantially remove any emitter material accumulated over the lift-off layer.

5. A method as in claim 4 wherein the emitter-material depositing step entails depositing the emitter material for a time sufficient to enable the emitter material to accumulate in the dielectric openings generally in the shape of cones pointing away from the lower non-insulating region.

6. A method as in claim 4 wherein the gate-material providing step entails depositing part of the gate material into space below the particles and above the insulating layer.

7. A method as in claim 1 wherein the introducing step comprises:

depositing the emitter material over the gate layer and through the gate openings into the dielectric openings; and removing at least part of the emitter material accumulated over the gate layer outside the dielectric openings.

8. A method as in claim 7 wherein the emitter-material depositing step entails depositing the emitter material for a time sufficient to enable the emitter material to accumulate in the dielectric openings generally in the shape of cones pointing away from the lower non-insulating region.

9. A method as in claim 7 wherein the emitter-material removing step is performed electrochemically.

10. A method as in claim 1 further including, prior to the distributing step, the step of providing an intermediate layer over the insulating layer such that the particles are subsequently distributed over the intermediate layer above the insulating layer.

11. A method as in claim 10 further including, between the particle removing step and the insulating-layer etching step, the step of etching the intermediate layer through the gate openings to form corresponding intermediate openings through the intermediate layer, the insulating-layer etching step also being performed through the intermediate openings.

12. A method as in claim 11 wherein the intermediate layer adheres to both the insulating and gate layers.

13. A method as in claim 11 wherein the intermediate layer inhibits clumping of the particles during the distributing step.

14. A method as in claim 13 wherein the distributing step is performed under the influence of an applied electric field.

15. A method as in claim 11 wherein the introducing step comprises:

depositing the emitter material over the gate layer and through the gate and intermediate openings; and electrochemically removing at least part of the emitter material accumulated over the gate layer outside the dielectric openings.

16. A method as in claim 11 wherein the intermediate layer comprises electrically non-insulating material.

17. A method as in claim 11 wherein the gate layer comprises at least two sublayers of different chemical composition.

18. A method as in claim 1 wherein the gate material comprises metal through which it is difficult to accurately etch small openings.

19. A method as in claim 1 wherein the gate material comprises gold.

20. A method as in claim 1 further including the steps of:

forming, prior to the distributing step, a pattern-transfer layer over the insulating layer;

removing, between the distributing step and the gate-material providing step, material of the pattern-transfer layer not shadowed by the particles to create corresponding pedestals from the pattern-transfer layer;

removing, between the gate-material providing step and the insulating-layer etching step, the pedestals.

21. A method as in claim 20 wherein the gate-material providing step entails selectively depositing the gate material over material of the insulating layer not shadowed by the particles.

22. A method as in claim 1 wherein the diameter of each gate opening generally decreases in going downward through that gate opening.

23. A method comprising the steps of:

distributing a multiplicity of particles over an electrically insulating layer;

providing electrically non-insulating gate material over the insulating layer such that the gate material covers space between the particles and extends substantially into space below the particles and above the insulating layer;

removing the particles and substantially any material overlying the particles such that the remaining gate material forms a gate layer though which beveled gate openings extend at the locations of the so-removed particles;

etching the insulating layer through the beveled gate openings to form corresponding dielectric openings through the insulating layer substantially down to a lower electrically non-insulating region provided below the insulating layer; and forming electron-emissive elements over the lower non-insulating region such that each electron-emissive element is at least partially situated in a corresponding one of the dielectric openings.

24. A method as in claim 23 wherein each beveled gate opening generally decreases in diameter in going downward through that gate opening toward the lower non-insulating region such that the diameter of each gate opening reaches a minimum value at or near the lower non-insulating region.

25. A method as in claim 24 wherein the particles are largely spherical.

26. A method as in claim 24 wherein the minimum value of the diameter of each gate opening is less than the average diameter of the particle provided over the insulating layer at the location of that gate opening.

27. A method as in claim 24 wherein the gate material providing step is performed in a non-collimated manner.

28. A method as in claim 24 wherein the gate material providing step is performed by non-collimated sputtering.

29. A method as in claim 24 wherein the electron-emissive element forming step comprises:

depositing a lift-off layer over the gate layer such that the lift-off layer covers the edges of the gate layer at the gate openings without extending significantly laterally beyond the edges of the gate layer at the gate openings;

depositing electrically non-insulating emitter material over the lift-off layer and through the gate openings into the dielectric openings to at least partially form the electron-emissive elements; and removing the lift-off layer so as to substantially remove any material overlying the lift-off layer.

30. A method as in claim 29 wherein the lift-off layer depositing step is performed at a deposition angle of 20°–50° relative to the upper surface of the insulating layer.

31. A method as in claim 29 wherein the emitter material accumulates over the lower non-insulating region to form the electron-emissive elements generally in the shape of cones.

32. A method as in claim 24 wherein the electron-emissive element forming step comprises:

depositing electrically non-insulating emitter material over the gate layer and through the gate openings into the dielectric openings to at least partially form the electron-emissive elements; and removing at least part of the emitter material accumulated over the gate layer outside the dielectric openings such that the electron-emissive elements are externally exposed through the beveled gate openings.

33. A method as in claim 32 wherein the removing step is performed electrochemically.

34. A method as in claim 32 wherein the emitter material accumulates over the lower non-insulating region to form the electron-emissive elements generally in the shape of cones.

35. A method comprising the steps of:

distributing a multiplicity of particles over a pattern-transfer layer formed above an electrically insulating layer;

creating corresponding pedestals from the pattern-transfer layer by removing material of the pattern-transfer layer not-shadowed by the particles;

providing electrically non-insulating gate material over the insulating layer at least in space between the pedestals;

removing the pedestals and substantially any material, including the particles, overlying the pedestals such that the remaining gate material forms a gate layer through which gate openings extend at the locations of the so-removed particles;

etching the insulating layer through the gate openings to form corresponding dielectric openings through the insulating layer substantially down to a lower electrically non-insulating region provided below the insulating layer; and forming electron-emissive elements over the lower non-insulating region such that each electron-emissive element is at least partially situated in a corresponding one of the dielectric openings.

36. A method as in claim 35 wherein the gate-material providing step comprises selectively depositing the gate material over material of the insulating layer not shadowed by the particles.

37. A method as in claim 35 further including the steps of:

forming, prior to the distributing step, (a) an electrically non-insulating intermediate layer over the insulating layer and (b) the pattern-transfer layer over the intermediate layer; and etching, subsequent to the gate-material providing step, the intermediate layer through the gate openings to form corresponding intermediate openings through the intermediate layer down to the insulating layer, the insulating-layer etching step also being performed through the intermediate openings.

38. A method as in claim 37 wherein the gate-material providing step comprises electrochemically depositing the gate material over material of the intermediate layer not shadowed by the pedestals.

39. A method as in claim 35 wherein the pedestal-creating step comprises:

exposing the pattern-transfer layer to actinic radiation using the particles as an exposure mask to cause material of the pattern-transfer layer not shadowed by the particles to change chemical composition; and removing the chemical changed material of the pattern-transfer layer.

40. A method as in claim 35 wherein the pedestal-creating step comprises anisotropically etching the pattern-transfer layer using the particles as an etch mask.

* * * * *